US012329276B2

(12) United States Patent
Soytürk

(10) Patent No.: US 12,329,276 B2
(45) Date of Patent: Jun. 17, 2025

(54) SHELF

(71) Applicant: Zarges GmbH, Weilheim, DE (US)

(72) Inventor: Erkan Soytürk, Weilheim (DE)

(73) Assignee: Zarges GmbH, Weilheim (DE)

( * ) Notice: Subject to any disclaimer, the term of this patent is extended or adjusted under 35 U.S.C. 154(b) by 0 days.

(21) Appl. No.: 18/125,097

(22) Filed: Mar. 22, 2023

(65) Prior Publication Data

US 2023/0301428 A1 Sep. 28, 2023

(30) Foreign Application Priority Data

Mar. 22, 2022 (DE) ..... 20 2022 101 496.5

(51) Int. Cl.
*A47B 57/20* (2006.01)
*A47B 57/48* (2006.01)

(52) U.S. Cl.
CPC ..... *A47B 57/20* (2013.01); *A47B 57/48* (2013.01)

(58) Field of Classification Search
CPC ..... A47B 57/20; A47B 57/48; A47B 57/404; A47B 57/30; A47B 57/40; A47B 88/43; A47B 2210/0059
USPC ..... 108/28; 312/334.4, 334.7–334.13; 248/346, 243, 248, 220.41
See application file for complete search history.

(56) References Cited

U.S. PATENT DOCUMENTS 1,288,010 A * 12/1918 Isacc ..... A47B 57/42 5/299
1,504,523 A * 8/1924 Sherer ..... A47B 57/425 248/222.51
2,992,055 A 7/1961 Kass
3,261,585 A 7/1966 Costantini et al.
3,631,821 A * 1/1972 Zachariou ..... A47B 57/42 211/187
4,193,649 A * 3/1980 Sharon ..... A47B 88/407 248/248
4,566,743 A 1/1986 Henriott
(Continued)

FOREIGN PATENT DOCUMENTS

DE 1996191 U 11/1968
DE 8802388 U1 5/1988
(Continued)

OTHER PUBLICATIONS

Search Report issued in German Patent Application No. DE 20 2022 101 496.5, dated Oct. 21, 2022 (from which this application claims priority) and English language translation thereof.
(Continued)

*Primary Examiner* — Janet M Wilkens
(74) *Attorney, Agent, or Firm* — Ewers IP Law PLLC; Falk Ewers

(57) ABSTRACT

A shelf is provided including shelf frames having hole lines, in particular formed by one front and one rear bar each and comprising pull-out rails which extend substantially horizontally along one shelf frame each, in particular from a front bar to a rear bar, and are mounted thereon via a front rail holder and via a rear rail holder. An upper and a lower hook pin are formed on each rail holder, which hook pins are intended for engagement in holes of the hole lines and engage behind wall regions adjacent to the holes, in particular bar wall regions. The upper hook pin of the rear rail holder points upwards. The lower hook pin of the rear rail holder points upwards.

13 Claims, 9 Drawing Sheets

(56) References Cited

U.S. PATENT DOCUMENTS

| | | | | | |
|---|---|---|---|---|---|
| 4,610,487 | A * | 9/1986 | Delmege | A47B 88/57 | 384/18 |
| 4,681,289 | A * | 7/1987 | Gronlund | A47B 88/43 | 248/224.8 |
| 4,834,555 | A * | 5/1989 | Grass | A47B 88/43 | 384/22 |
| 4,917,337 | A * | 4/1990 | Gridley | A47F 5/0823 | 248/222.12 |
| 6,070,957 | A * | 6/2000 | Zachrai | H02B 1/32 | 312/265.2 |
| 2005/0122015 | A1* | 6/2005 | Hightower | A47B 67/04 | 312/334.5 |
| 2012/0018605 | A1* | 1/2012 | Lacarra | A47B 88/43 | 211/163 |

FOREIGN PATENT DOCUMENTS

| | | | | |
|---|---|---|---|---|
| DE | 19710023 | C1 | 4/1998 | |
| DE | 20216734 | U1 | 12/2002 | |
| EP | 195576 | A2 | 9/1986 | |
| EP | 1847198 | A1 * | 10/2007 | A47B 88/044 |

OTHER PUBLICATIONS

European Search Report dated Aug. 9, 2023 of European counterpart application No. EP 23163353.8, and English language translation thereof.

* cited by examiner

SHELF

CROSS REFERENCE TO RELATED APPLICATIONS

This application claims priority to German utility model application DE 20 2022 101 496.5, filed Mar. 22, 2022, the entire content of which is incorporated herein by reference.

TECHNICAL FIELD

The present disclosure relates to a shelf.

BACKGROUND

Such shelves have been known for a long time. They often have hole lines attached to shelf frames, i.e., shelf walls for instance. The shelf frames can either be formed as solid walls or consist of two bars, a front and a rear bar.

The hole lines can be integrated into the shelf frames or the bars, or they can be attached to them. In the latter case, they often consist of metal sheet strips attached to the shelf frames. Any shelf elements such as shelf panels, pull-outs, drawers or even telescopic rails can be attached to the holes in the hole lines.

The holes of the hole lines are configured in a predetermined grid dimension. This makes it possible to attach the shelf elements at any height, and also to change the desired height afterwards if necessary. For this purpose, the shelf elements have clips or pins or other suitable connecting elements that extend into the holes in the hole lines and support the shelf element in question.

Typically, a shelf element is stored in at least four places, i.e. left front, left rear, right front and right rear.

Each bearing point may be formed by the engagement of the connecting element in the hole concerned, or, if necessary, by the engagement in two holes arranged one above the other. It has also become known to form the connecting elements not directly on the shelf element, but on an adapter, which in turn is connected to the shelf element.

An example of the storage of telescopic rails on hole lines is the shelf known from DE 88 02 388 U1. In this shelf, an adapter for telescopic rails is provided which can be inserted into holes of hole lines via clips. A front hole line and a rear hole line are provided, which are formed on a front bar and a rear bar, respectively.

The clip attached to the rear of the telescopic rail or the adapter there can be inserted into a rear hole from the front. The clip attached to the front of the telescopic rail can be inserted from above into the front hole on the front bar, i.e. the front hole line. However, this design did not prevail on the market. One problem was the play of the adapter's bearing, on the one hand on the telescopic rail and on the other hand on the hole line.

Another example of a shelf system with hole lines arranged in a grid pattern is the solution known from DE 19 96 191 U1. It has also been suggested that a bearing point be provided by two adjacent holes in a hole line, each of which is engaged by pins. With the double bearing at each bearing point, the stability can be significantly increased. However, it has been shown that in certain load situations, long term stability in particular can be improved.

SUMMARY

Therefore, it is an object of the disclosure to provide a shelf and a rail holder, which show improved long-term stability under different load situations.

This object is achieved by a shelf and a rail holder as described herein.

According to a first aspect this object is solved by a shelf comprising shelf frames having hole lines, in particular formed by one front and one rear bar each and comprising pull-out rails which extend substantially horizontally along one shelf frame each, in particular from a front bar to a rear bar, and are mounted thereon via a front rail holder and via a rear rail holder, wherein an upper and a lower hook pin are formed on each rail holder, which hook pins are intended for engagement in holes of the hole lines and engage behind wall regions adjacent to the holes, in particular bar wall regions, and wherein the upper hook pin of the rear rail holder points upwards, characterized in that the lower hook pin of the rear rail holder points upwards.

In a technically advantageous embodiment of the shelf the hooks of the upper hook pins are longer than those of the lower ones.

In a further technically advantageous embodiment of the shelf the pin portions of the hook pins extend in and pass through the holes and the hooks of the hook pins extend distally from the pin portions.

In a further technically advantageous embodiment of the shelf the hooks terminate at hook end faces and the pin portions each have pin mating faces opposite the hooks, and for lower hook pins the distance between end face and mating face is less than the diameter of the holes.

In a further technically advantageous embodiment of the shelf for the upper hook pins the distance between end face and mating face is greater than the diameter of the holes.

In a further technically advantageous embodiment of the shelf the distance between the hook pins of a rail holder corresponds to the distance between adjacent holes of the hole lines, and the hook pins of a rail holder can be fixed in the adjacent holes by inserting the upper hook pins, lifting the rail holders and inserting the lower hook pins in the bars.

In a further technically advantageous embodiment of the shelf the upper hook pin of the front rail holder points upwards and/or the lower hook pin of the front rail holder points downwards.

In a further technically advantageous embodiment of the shelf the pin portion of the lower hook pin has a clearance with respect to the hole of between 3% and 20%, in particular between 6% and 13% and particularly preferably around 9%, of its diameter.

In a further technically advantageous embodiment of the shelf the vertical protrusion of the hook of the lower hook pin with respect to the pin portion is between 2% and 18%, in particular between 5% and 12% and particularly preferably around 8%, of the diameter of the pin portion.

In a further technically advantageous embodiment of the shelf between the lower hook of the rear rail holder and an abutment surface for the abutment of the rail holder on the outside of the bar, a vertically downwardly extending slit is formed, the width of which corresponds substantially to the thickness of the bar wall.

In a further technically advantageous embodiment of the shelf the slit tapers downwards at a cone angle between 1 degree and 20 degrees.

In a further technically advantageous embodiment of the shelf the lower hook pin extends at the level of a support leg supporting the pull-out rail and/or that the rail holder has an L-shaped cross-section.

In a further technically advantageous embodiment of the shelf the pull-out rail is designed as a multi-part telescopic rail, the pull-out length of which corresponds to or is greater than the distance between the front and rear bars.

In a further technically advantageous embodiment of the shelf a right-hand pull-out rail supports a pull-out on the right and a left hand pull-out rail on the left, and in that the respectively associated rail holders are configured to be mirror-symmetrical with respect to one another.

In a further technically advantageous embodiment of the shelf the pull-out can be loaded with a weight which corresponds to a multiple, in particular at least six times, the torsional resistance force of each pull-out rail in the unmounted state which the latter opposes to a torsional force.

According to a second aspect this object is solved by a rail holder on which an upper and a lower hook pin are configured which are intended for engagement into holes of hole lines and which engage behind wall regions, in particular bar wall regions, adjacent to the holes, and wherein the upper hook pin of the rail holder points upwards, wherein the lower hook pin of the rail holder points upwards.

According to the disclosure, a shelf is provided which can be equipped with pull-out rails which are mounted in a special manner on the shelf frames. For this purpose, the shelf has hole lines mounted vertically on the shelf frames, said hole lines having holes in a predetermined grid dimension. According to the disclosure, the pull-out rails can be stored in the holes, but also any other shelf elements such as shelf panels, drawers, simple pull-outs or the like.

Shelf frames stand on the floor in a manner known per se. They can be formed, for example, by solid walls, or each have individual bars. The hole lines can be integrated into these, or they can be formed in strips of material which extend along the shelf frames and are attached to them.

In a manner known per se, one front and one rear hole line is provided, and when bars are used, one front and one rear bar. Shelf boards, drawers, telescopic pull-outs and similar shelf elements are typically mounted on both sides. Accordingly, rails, rail holders, hole lines, etc., are each formed on both sides of the shelf element, i.e. in this respect on its right and left side, and as a rule in mirror image of each other. Here and in the following, only one side is considered for the sake of simplicity.

According to the disclosure, a rail holder is mounted at the front and at the rear of the shelf frame, respectively, for supporting the pull-out rail of a telescopic pull-out, and at the front and at the rear bar in the case of the realization of bars. According to the disclosure, each rail holder is equipped with two vertically spaced hook pins. The spacing of these is such that, in the assembled state, the upper hook pin engages in an upper hole of the hole line, and the lower hook pin engages in the lower hole adjacent to the upper hole. Hook pins have the advantage of extending through a hole and resting against the wall of the bar or shelf frame on the other side of the hole. This allows for clearance-free storage, assuming an appropriate fit.

Hook pins consist of hooks which extend transversely to pin portions. The hook pin is attached to the rail holder such that its pin portion extends laterally, i.e., substantially horizontally. The hook of the hook pin extends upwardly or downwardly from the pin portion, that is, substantially vertically. The pin portion is configured to pass through a hole of the hole line. In the case of round holes, it is also preferably round. It is only about as long as the horizontal extension of the hole, i.e. as long as the wall thickness of the shelf frame, e.g. of a bar.

Due to this design, the hook of the hook pin rests against the back of the shelf frame and the pull-out rail is supported on the shelf frame without play in the horizontal direction.

According to the disclosure, 2 hook pins are formed on each rail holder, an upper and a lower one. The upper hook pin of the rear rail holder points upwards, and according to the disclosure, the lower hook pin of the rear rail holder also points upwards. This design has the particular effect that when the telescopic pull-out is loaded in the extended state, both hook pins are each pressed upwards in their hole in the hole line. Then, the hook of the lower hook pin therefore also engages behind the shelf frame or the bar wall in which the hook pin is guided. The rail holder is thus forced into an upright position resting against the shelf frame.

This has the following special effect:

When the telescopic pull-out is loaded in the extended state, the telescopic rail acts like a two-armed lever mounted on the front rail holder. The force arm, i.e. the part of the rail between the front and rear rail holder, tends to twist, as it were, to avoid the applied force.

Without the inventive measure, i.e., a lower rear hook pinpointing upwards, the telescopic rail could twist in itself and the lower hook pin could slip out of its anchorage, leading to failure of the telescopic pull-out. In contrast, according to the disclosure, the pull-out rail is always guided closely at the shelf frame, even in the rear area. There, it rests with a holder contact surface against the bar or the shelf frame. This also applies in the extended and loaded state of the telescopic pull-out.

Preferably, on the other hand, the hook of the lower hook pin of the front rail holder is directed downward, and the hook of the upper hook pin is directed upward. When the telescopic pull-out is loaded, the front rail holder bears almost the entire weight of the telescopic pull-out, and the lower hook pin takes up a large part of it. Its downward-facing hook securely engages behind the bar wall.

In an advantageous embodiment, the hooks of the lower hook pins are shorter than those of the upper ones. For insertion into the holes of the hole lines, the upper hook pin is inserted first and then the lower hook pin when the telescopic rail is tilted in a manner known per se. In this way, both the front and the rear rail holder are brought into contact with the shelf frame with their holder contact surface.

When the telescopic pull-out is inserted, its weight rests substantially evenly on its 4 rail holders. As a result, the rear rail holders are also subjected to a downward force. This can push the lower hook pin of the rear rail holder down so far that its hook no longer engages behind the bar wall but is at the level of its hole. This "release" is harmless, however, because the load of the pull-out tries to push the lower hook pin outward, i.e. toward the bar, where it cannot escape because of the action of the holder contact surface.

Surprisingly, this means that the—comparatively simple—inventive measure of having the lower rear hook pin with its hook pointing upwards ensures secure and also durable mounting and guidance of a telescopically guided pull-out. It also resists twisting forces in that, if twisting of the telescopic rail occurs, this is compensated for by the special design of the rear rail holder.

In an advantageous embodiment, it is provided that the rail holder has a bearing leg with the hook pins and a support leg supporting the pull-out rail, and that a contact surface, possibly provided with an aperture, is formed on the bearing leg for contact on the outside of the bar, the distance of which from the hook, viewed in vertical projection, corresponds to the wall thickness of the bar wall.

BRIEF DESCRIPTION OF THE DRAWINGS

The disclosure will now be described with reference to the drawings wherein.

DESCRIPTION OF EXEMPLARY EMBODIMENTS

Figure 1:
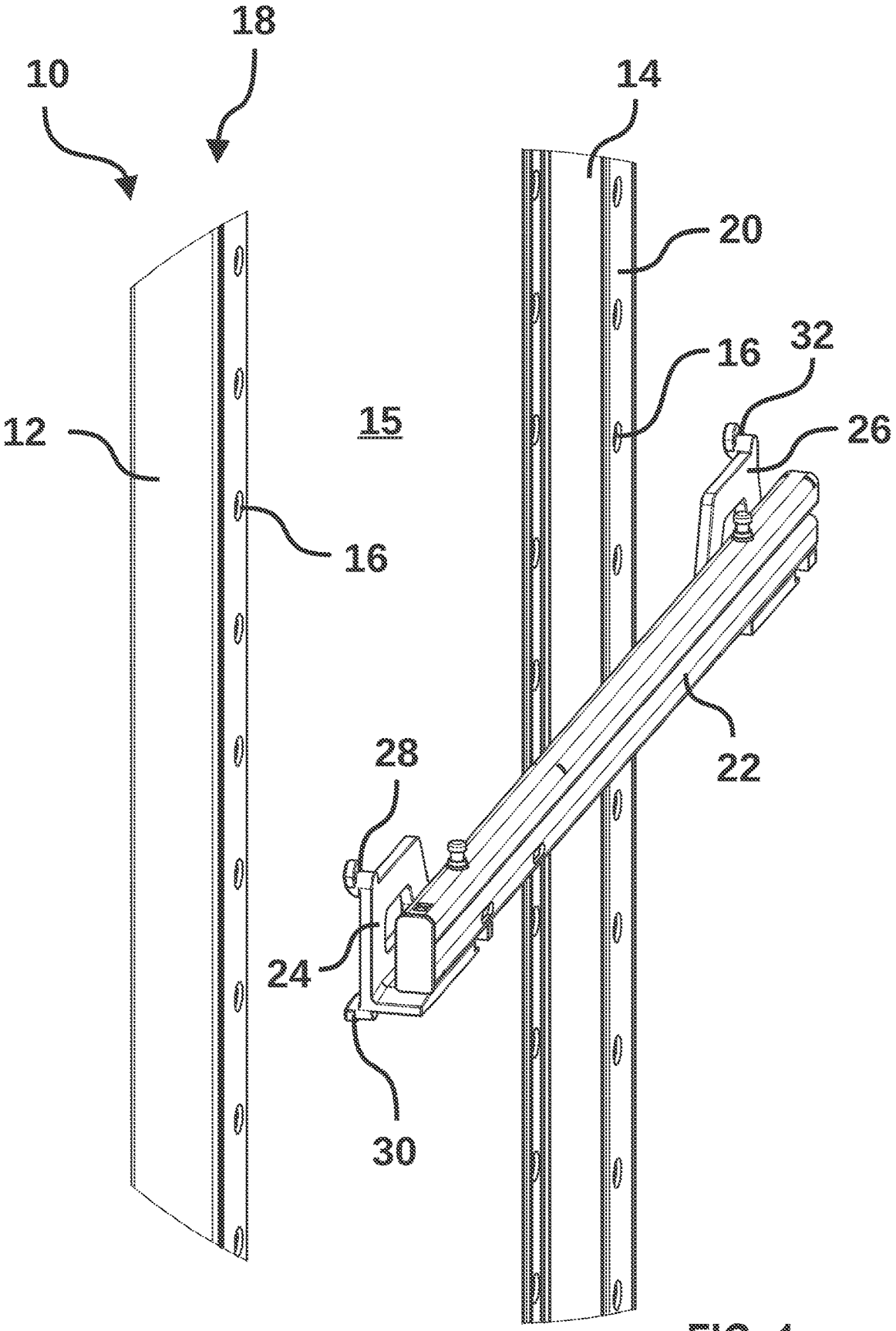
FIG. 1 shows a schematic perspective drawing of a part of a shelf, showing a part each of a front and a rear bar, and a telescopic rail, in an unassembled state, according to an exemplary embodiment of the disclosure.

A small section of a shelf 10 is shown in FIG. 1. The shelf 10 has 4 bars, of which a front bar 12 can be seen in FIG. 1. The front bar 12 is spaced from a rear bar 14 and rests on the floor. Both bars 12 and 14 form a shelf frame 15, in the illustration according to FIG. 1 a left shelf frame 15 of the shelf 10. The bars can be connected to each other, e.g. at the top and bottom, in any known manner, e.g., by a connecting strut not shown, for example by means of screw connections.

The shelf 10 can be part of a shelf system in which several individual shelves are connected to each other. The shelves can be equipped with different shelf elements as desired. The shelf 10 considered here is designed for a telescopic pull-out at the location shown, of which a left pull-out rail 22 is shown in the figures.

Bar 12 and bar 14 each have a plurality of holes 16 arranged one above the other in a grid pattern, i.e., at the same distance from one another. A front hole line 18 is thus formed on the front bar 12, and a rear hole line 20 is formed on the rear bar 12.

In the position shown in FIG. 1, the pull-out rail 22 is not yet hooked into holes 16 of the hole lines 18 and 20. A front rail holder 24 and a rear rail holder 26 are intended for hooking in. The rail holders 24 and 26 are an integral part of the pull-out rail 22.

The front rail holder 24 has two hook pins on its side facing the hole line 18, namely an upper hook pin 28 and a lower hook pin 30. The rear rail holder 26 also has two hook pins, namely an upper hook pin 32 and a lower hook pin 34, which can be seen, for example, in FIG. 5.

The hook pins 28 to 34 have different orientations and configurations. The hook pins 28, 32 and 34 point upwards, and the hook pin 30 points downwards. Furthermore, the upper hook pins 28 and 32 are slightly longer than the lower hook pins 30 and 34. Each of the hook pins consists of a pin portion 36, better seen in FIGS. 7 and 8, and a hook 38.

The distance from the top of the pin portion 36 of the upper hook pin 28 to the bottom of the hook 38 of the lower hook pin 30 on the front rail holder 24 is slightly less than the distance from the bottom edge of the hole 16 intended for engagement of the lower hook pin 30 to the top edge of the hole 16 intended for engagement of the upper hook pin 28.

The distance from the top of the pin portion 36 of the upper hook pin 32 to the bottom end of the pin portion 36 of the lower hook pin 34 on the rear rail holder 26 is slightly less than the distance from the bottom edge of the hole 16 intended for engagement of the lower hook pin 34 to the top edge of the hole 16 intended for engagement of the upper hook pin 32.

The distance from the upper end surface of the hook 38 of the upper hook pin 28 to the underside of the pin portion 36 of the lower hook pin 30 on the front rail holder 24 is slightly larger than the distance from the lower edge of the hole 16 intended for engagement of the lower hook pin 30 to the upper edge of the hole 16 intended for engagement of the upper hook pin 28.

The distance from the upper end surface of the hook 38 of the upper hook pin 32 to the underside of the pin portion 36 of the lower hook pin 34 on the rear rail holder 26 is slightly larger than the distance from the lower edge of the hole 16 intended for engagement of the lower hook pin 34 to the upper edge of the hole 16 intended for engagement of the upper hook pin 32.

Figure 2:
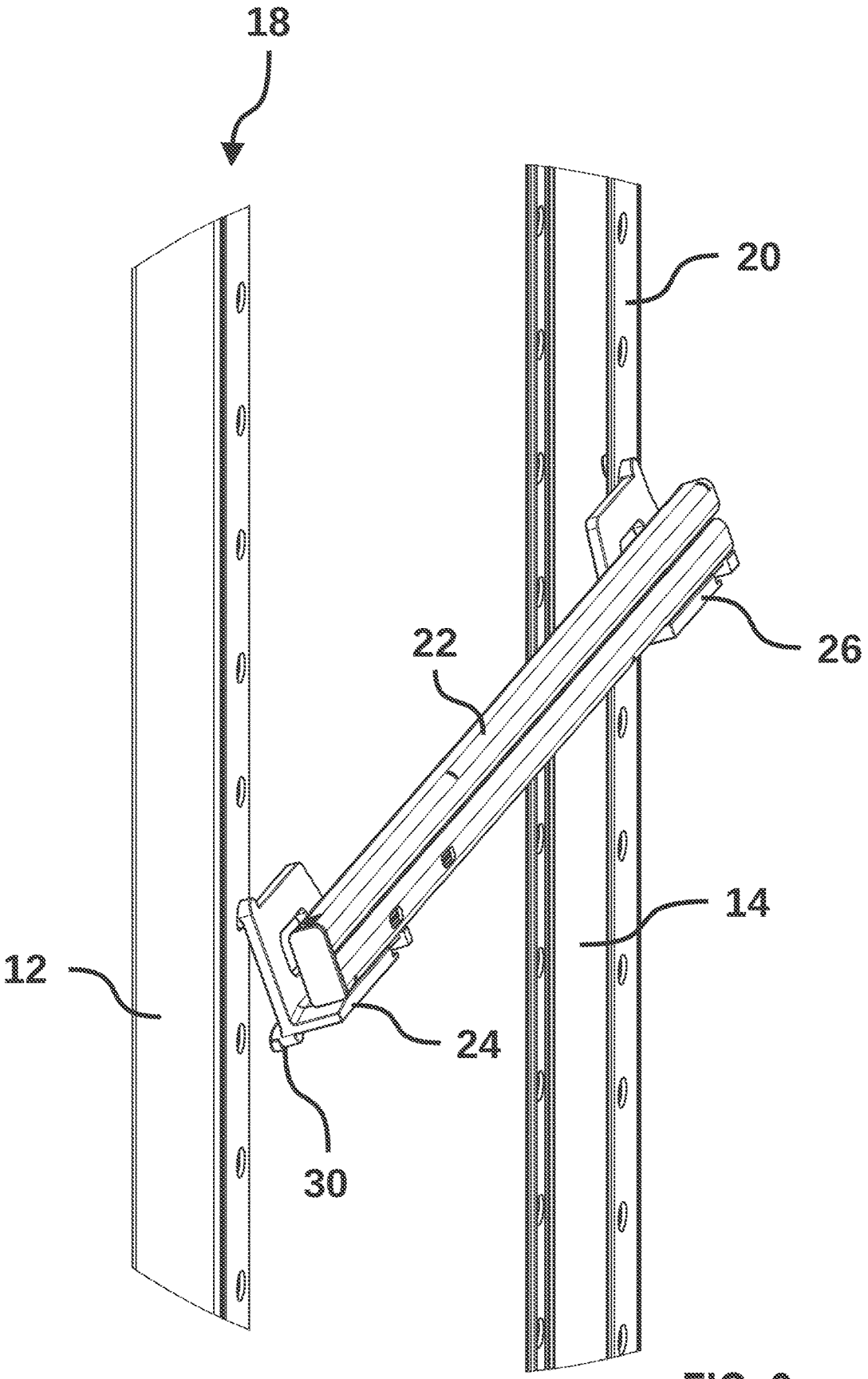
FIG. 2 shows a schematic perspective drawing of the part of the shelf as shown in FIG. 1, wherein the telescopic rail is tilted and inserted into holes of hole lines with the upper hook pins of the rail holders according to an exemplary embodiment of the disclosure.
Figure 3:
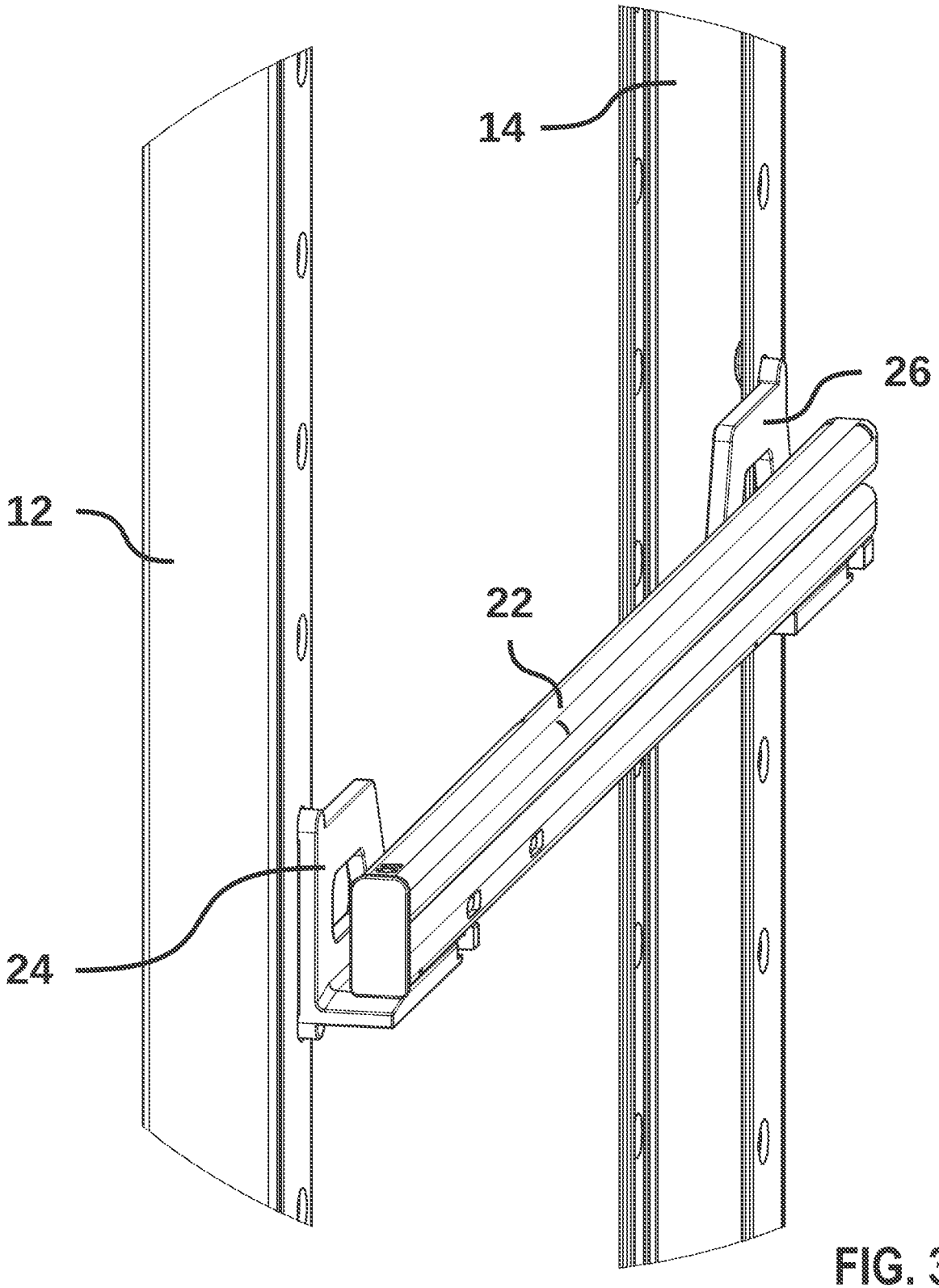
FIG. 3 shows a schematic perspective drawing of the part of the shelf as shown in FIG. 1, wherein the telescopic rail is inserted into holes of hole lines with the upper and the lower hook pins of the rail holders according to an exemplary embodiment of the disclosure.

With the dimensioning rules in the 4 preceding paragraphs, it is achieved that the pull-out rail 22 in raised condition can be inserted from the tilted position according to FIG. 2 into the position abutting against the bars 12 and 14 according to FIG. 3 and then be lowered, and that in this abutting, lowered position the pull-out rail 22 is locked against accidental falling out.

In the lowered position, the hooks 38 of the hook pins 28, 30 and 32 engage behind the bar wall, so the pull-out rail cannot be separated from the bars 12 and 14 either by tilting or swiveling or by pulling it straight out. For more information on the hook 38 of the lower hook pin 34 of the rear rail holder 26, please refer to the explanation below.

Figure 4:
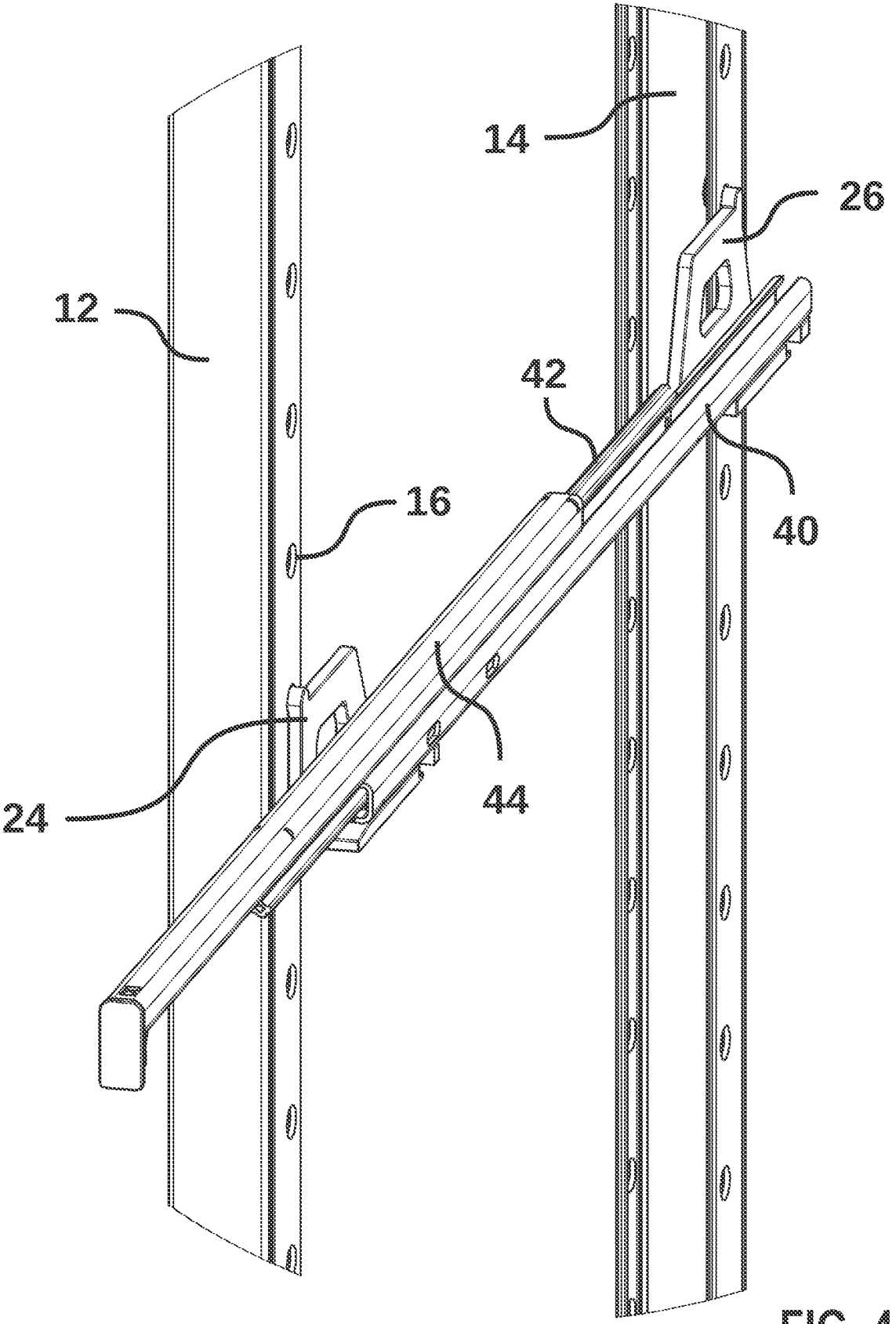
FIG. 4 shows a schematic perspective drawing of the part of the shelf as shown in FIG. 1, wherein the telescopic rail is inserted into holes of hole lines with the upper and lower hook pins of the rail holders and is also extended according to an exemplary embodiment of the disclosure.

FIG. 4 shows the pull-out rail 22 schematically in the partially extended state. A fixed part 40 is apparent, to which the rail holders 24 and 26 are attached. A first movable part 42 is mounted thereon, and a second movable part 44 is mounted thereon. A drawer or any other pull-out element such as a board is mounted on the second movable part 44.

When fully extended, this extends together with the second movable part 24 in front of the front bar 12. In this state, but also already in the state shown in FIG. 4, the pull-out rail acts like a two-sided lever, with the second movable part 44 as the load arm and the fixed part 40 as the power arm. The lever bearing point is then the front rail holder 24.

When a weight is applied to the pull-out element, the weight force is translated into an upward force via this two-sided lever. This force acts upward on the rear rail holder 26.

In this condition, the hook 38 of the lower hook pin 34 of the rear rail holder 26 comes into play according to the disclosure: in particular, when the weight force is so great that it could cause the pull-out rail 22 to swerve by twisting, the hook 38 of the hook pin 34 prevents twisting. The pull-out rail 22 has a much higher section modulus in the vertical direction than in the horizontal direction. Untwisted, it is therefore capable of absorbing considerable loads, whereas it easily fails when twisted.

In particular, twisting leads to wear of the guide elements provided internally in the pull-out rail 22. These may include, for example, balls or rollers that run on rolling bearing tracks. The rolling bearing tracks can have a semi-circular cross-section, for example, and would be widened, as it were, by twisting the pull-out rails, so that safe guidance by the guide elements would no longer be ensured.

In this respect, according to the disclosure, the long-term stability of the shelf with telescopic pull-out is substantially improved by the simple action of the hook 38 of the hook pin 34 of the rear rail holder 26. This hook points upwards so that, when the force on the rear rail holder 26 is directed upwards as described above, it engages behind the wall of the bar 14 and holds the rail holder 26 securely and, above all, upright on the rear bar 14 even in this loaded position.

Figure 5B:
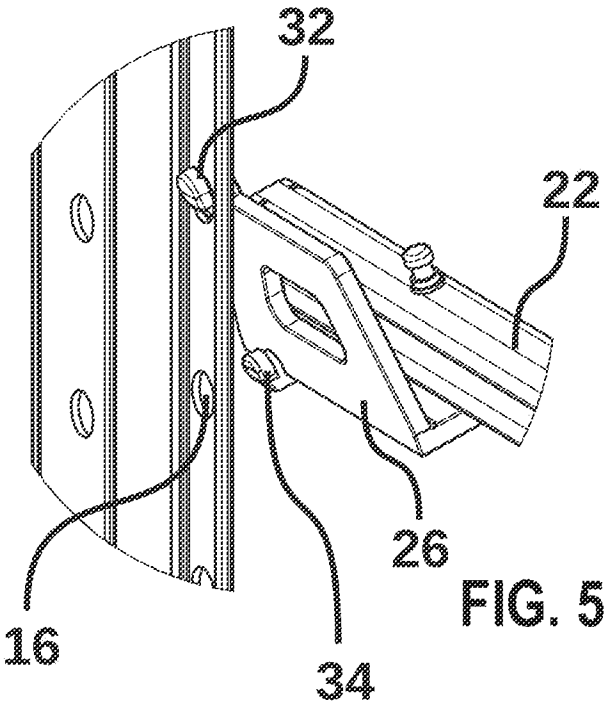
FIG. 5B shows an enlarged perspective view of a part of the shelf in the same exemplary embodiment of to the disclosure, in which the rear rail holder is tilted and inserted only with its upper hook pin into a hole of the hole line of the bar.
Figure 5A:
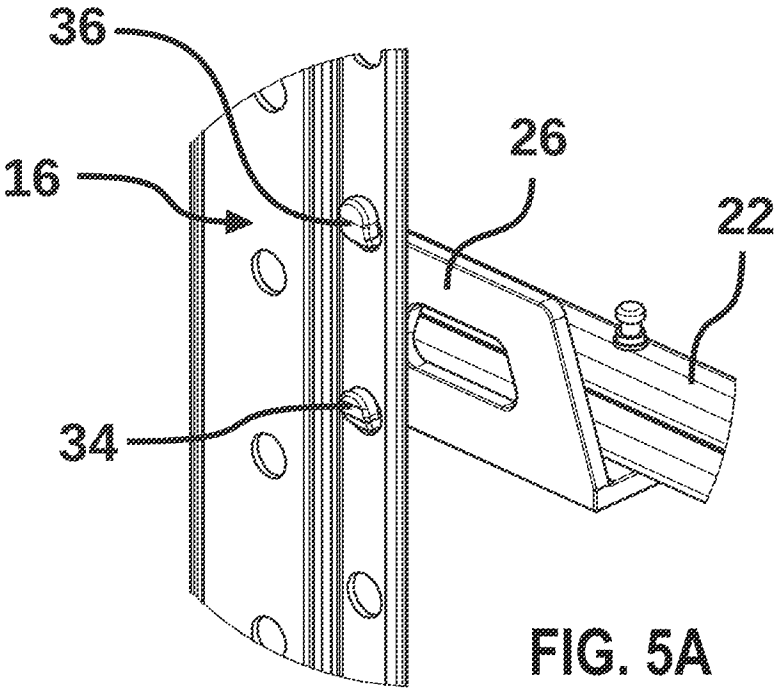
FIG. 5A shows an enlarged perspective view of a part of the shelf in the same exemplary embodiment of the disclosure, in which the engagement of a rear rail holder with both hook pins in the hole line of the bar is evident.

This position can be seen in FIGS. 5A and 5B. In FIG. 5A, the rear rail holder 26 is shown in the assembled position in which the weight force bearing on the telescopic pull-out pushes it upward. FIG. 5B shows that previously, that is, without the upward force, it can be readily inserted into the hole 16 in the tilted position with the hook 38 of the upper hook pin 32, and then pivoted so that the hook pin 34 can pass through the underlying hole 16.

Figure 6:
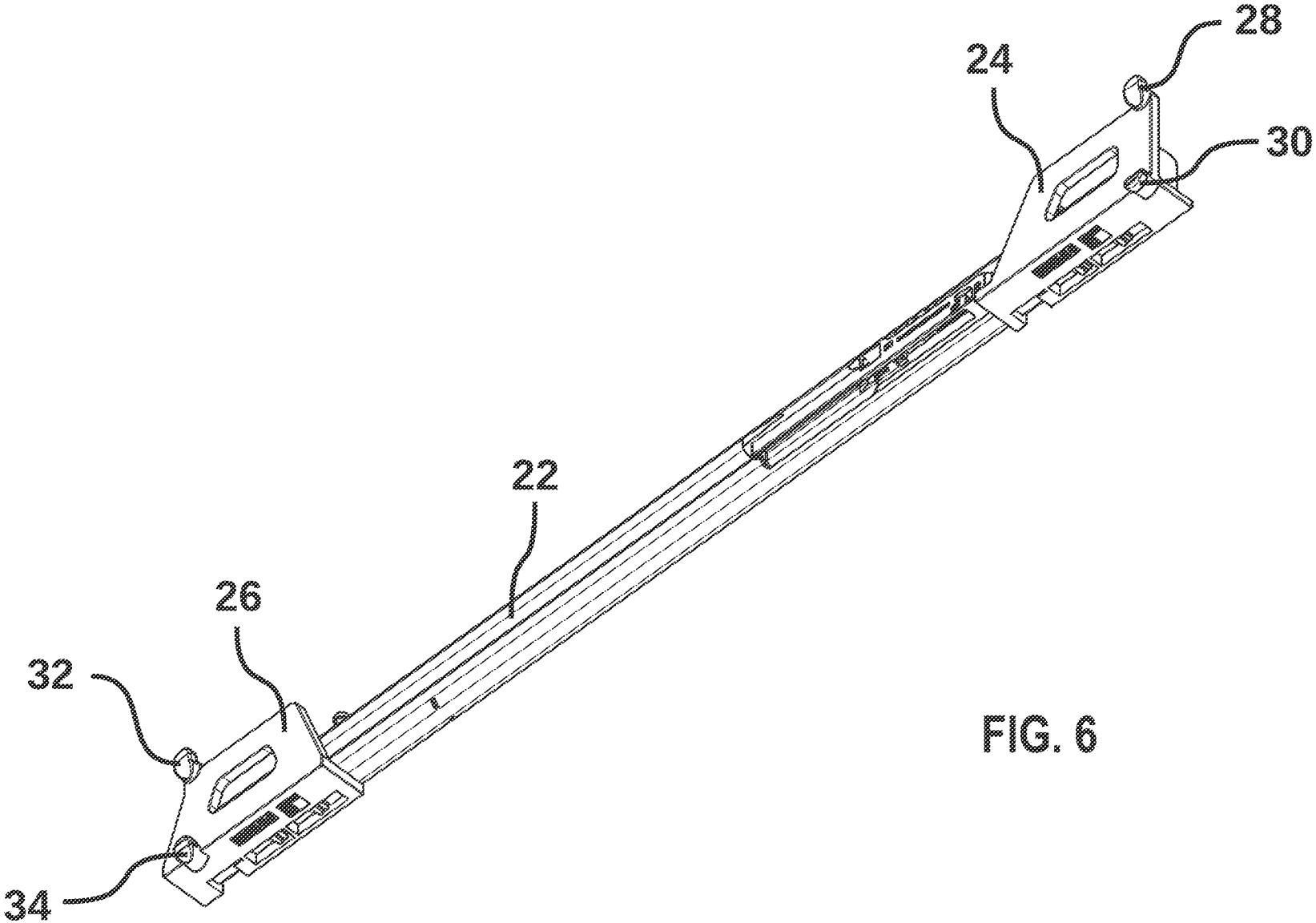
FIG. 6 shows a schematic perspective drawing of the part of the shelf as shown in FIG. 1, wherein the telescopic rail is shown.

FIG. 6 shows a perspective view of the pull-out rail with the fixed part 40, the rear rail holder 26 and the front rail holder 24. The position and arrangement of the hook pins 28, 30, 32, and 34 are also shown.

Figure 7:
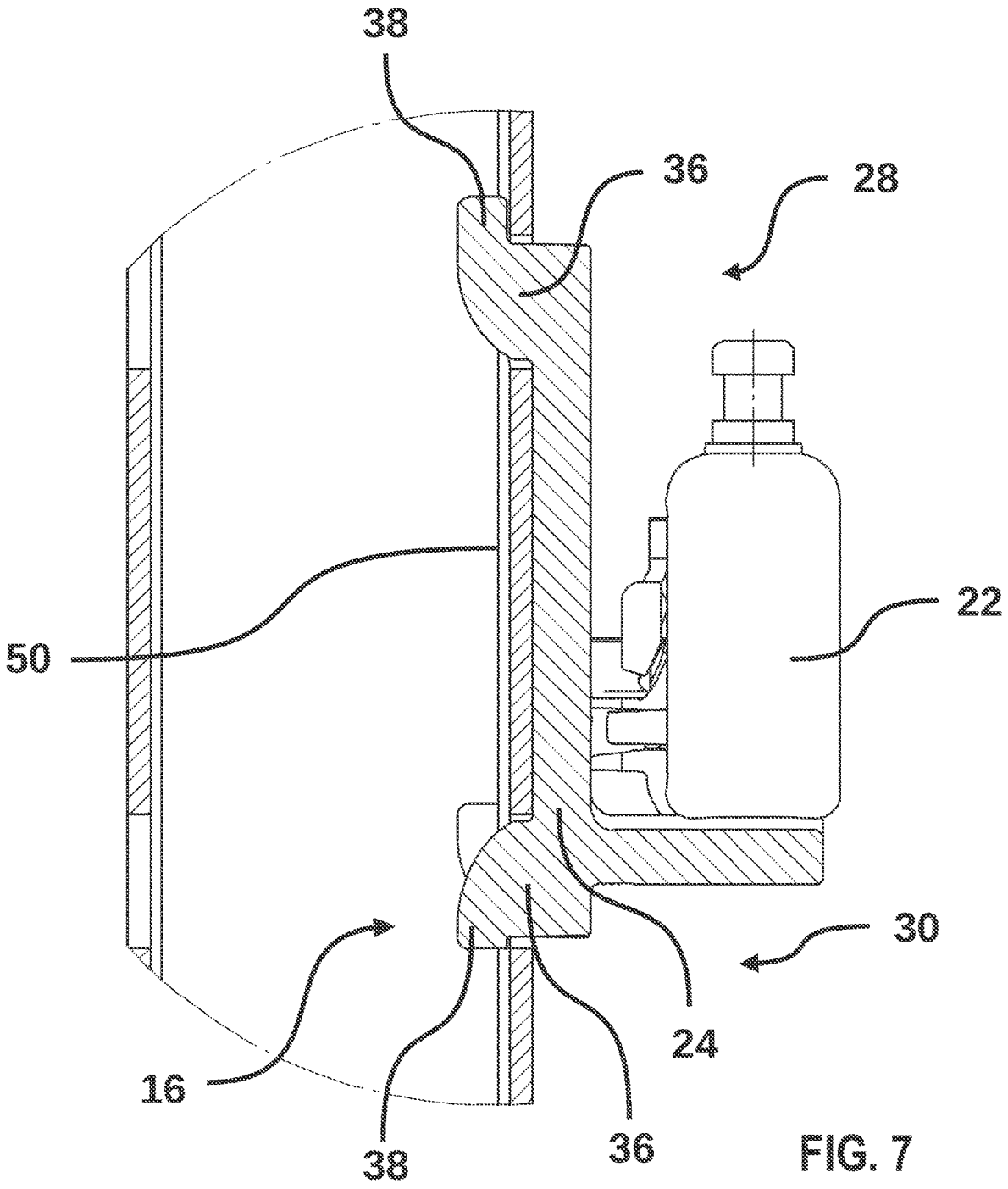
FIG. 7 shows a schematic sectional drawing of the part of the shelf as shown in FIG. 1, with the front rail holder shown.

FIG. 7 shows how the front rail holder 24 passes through holes 16 in the bar 12. Each hook pin 28 and 30 includes a pin portion 36 and a hook 38. The hook 38 of the upper hook pin 28 is longer than the downward facing hook 38 of the lower hook pin 30. The pin portions 36 are supported with some clearance in the holes 16.

Figure 8:
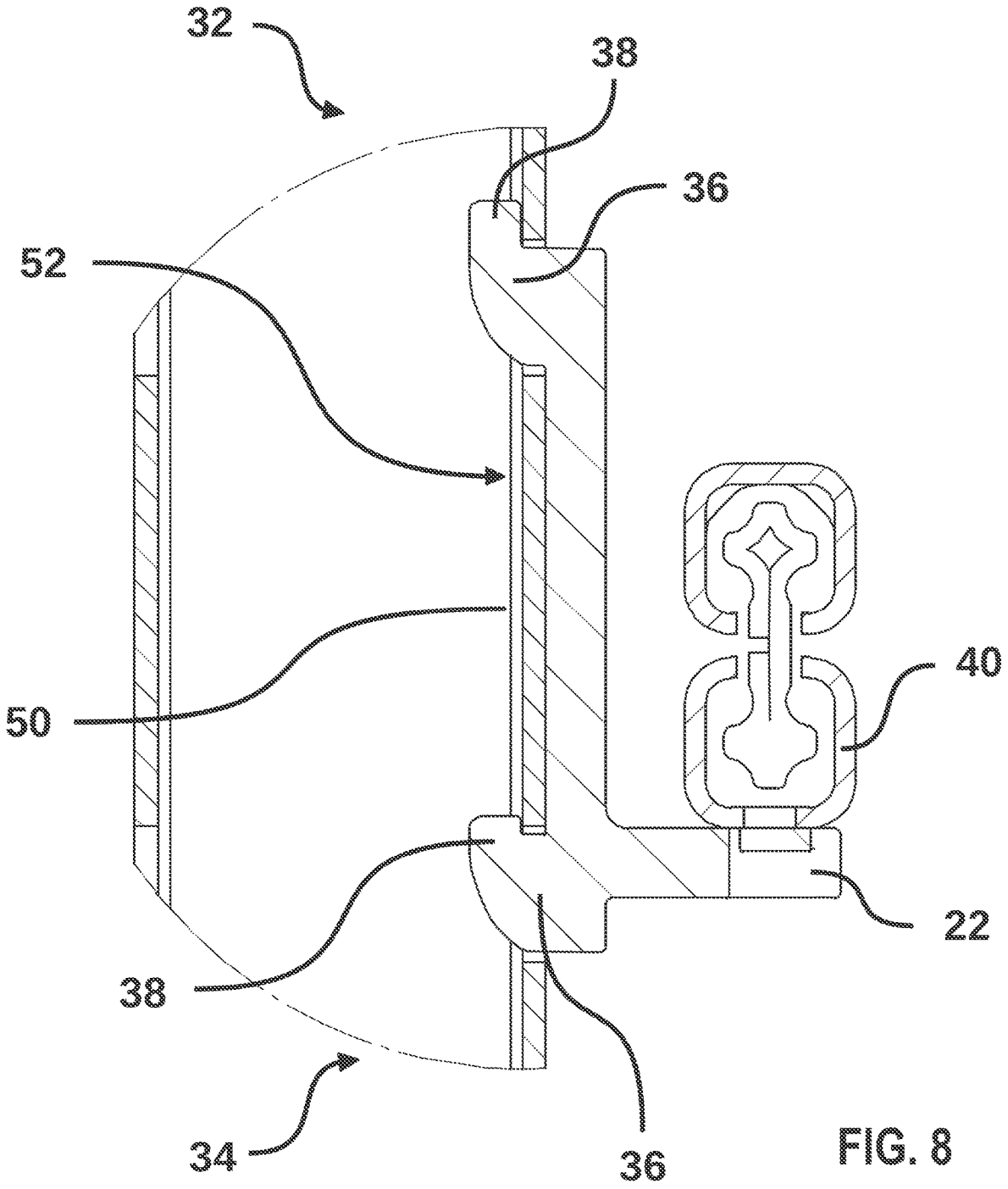
FIG. 8 shows a schematic sectional drawing of the part of the shelf as shown in FIG. 1, wherein the rear rail holder is shown.

FIG. 8 shows how the rear rail holder 26 is constructed in section. The hook pins 32 and 34 pass through the holes 16 with their pin portions 36, and the hooks 38 engage behind the wall 50 of the bar. The rail holder 26 rests against the wall 50 of the bar with an abutment surface 52. When an upward force is applied to the rail holder 26, both hooks 38 of the hook pins 32 and 34 extend to engage behind the wall 50.

Figure 9:
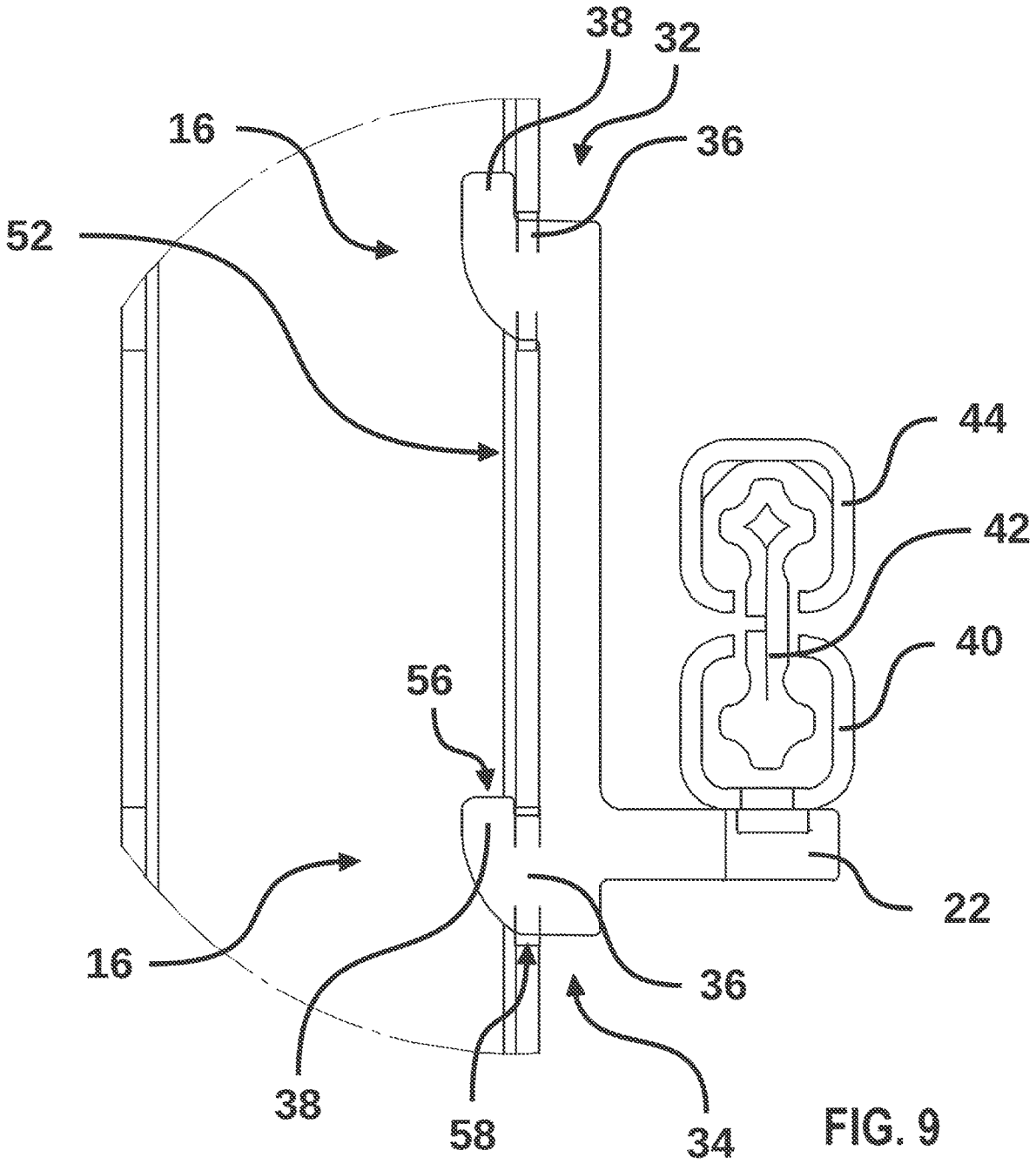
FIG. 9 shows a further enlarged sectional view of FIG. 8.

The more detailed design of the rear rail holder 26 can be seen in FIG. 9. It can be seen that the pin portions 36 are guided with clearance in the holes 16. The distance of the upper end portion 56 of the lower hook 38 to the underside 58 of the pin portion 36 of the lower hook pin 34 is so small that the hook pin 34 can pass through the hole 16.

However, this does not apply to the upper hook pin 32. Therefore, the upper hook pin 32 can only be inserted into its associated hole 16 when tilted. If, on the other hand, a force is applied upwards to the rail holder 26, both hook pins 32 and 34 lock so that secure storage is ensured.

It is understood that the foregoing description is that of the exemplary embodiments of the disclosure and that various changes and modifications may be made thereto without departing from the spirit and scope of the disclosure as defined in the appended claims.

What is claimed is:

1. A shelf, comprising:

shelf frames having hole lines formed by one front and one rear bar each and comprising pull-out rails which extend substantially horizontally along one shelf frame each from a front bar to a rear bar, and are mounted thereon via a front rail holder and via a rear rail holder, wherein an upper and a lower hook pin are formed on each rail holder, which hook pins are intended for engagement in holes of the hole lines and engage behind wall regions adjacent to the holes, or bar wall regions, wherein the upper hook pin of the rear rail holder points upwards, wherein the lower hook pin of the rear rail holder points upwards, and wherein a vertical protrusion of a hook of the lower hook pin with respect to a pin portion is between 2% and 18% of the diameter of the pin portion.

2. The shelf according to claim 1, wherein the hooks of the upper hook pins are longer than the hooks of the lower hook pins.

3. The shelf according to claim 1, wherein pin portions of the hook pins extend in and pass through the holes, and wherein the hooks of the hook pins extend distally from the pin portions.

4. The shelf according to claim 3, wherein the hooks terminate at hook end faces and the pin portions each have pin mating faces opposite the hooks, and wherein for lower hook pins the distance between end face and mating face is less than the diameter of the holes.

5. The shelf according to claim 4, wherein for upper hook pins the distance between end face and mating face is greater than the diameter of the holes.

6. The shelf according to claim 1, wherein the distance between the hook pins of a rail holder corresponds to the distance between adjacent holes of the hole lines, and hook pins of a rail holder can be fixed in the adjacent holes by inserting the upper hook pins, lifting the rail holders and inserting the lower hook pins in the bars.

7. The shelf according to claim 1, wherein the upper hook pin of the front rail holder points upwards and/or the lower hook pin of the front rail holder points downwards.

8. The shelf according to claim 1, wherein the pin portion of the lower hook pin has a clearance with respect to the hole of at least one between of 3% and 20%, between 6% and 13%, and around 9%, of its diameter.

9. The shelf according to claim 1, wherein the lower hook pin extends at the level of a support leg supporting the pull-out rail, and/or wherein the rail holder has an L-shaped cross section.

10. The shelf according to claim 1, wherein the pull-out rail is configured as a multi-part telescopic rail, the pull-out length of which corresponds to or is greater than the distance between the front and rear bars.

11. The shelf according to claim 1, wherein a right-hand pull-out rail supports a pull-out on the right and a left-hand pull-out rail on the left, and wherein the respectively associated rail holders are configured to be mirror-symmetrical with respect to one another.

12. The shelf according to claim 11, wherein the pull-out can be loaded with a weight which corresponds to a multiple, or at least six times, the torsional resistance force of each pull-out rail in the unmounted state which the latter opposes to a torsional force.

13. A rail holder on which an upper and a lower hook pin are configured which are intended for engagement into holes of hole lines and which engage behind wall regions adjacent to the holes, wherein the upper hook pin of the rail holder points upwards, wherein the lower hook pin of the rail holder points upwards, and wherein a vertical protrusion of a hook of the lower hook pin with respect to a pin portion is between 2% and 18% of the diameter of the pin portion.

* * * * *